US009312084B2

(12) United States Patent
Rösch et al.

(10) Patent No.: US 9,312,084 B2
(45) Date of Patent: Apr. 12, 2016

(54) CONTACT SLIDER UNIT FOR A SWITCHING UNIT, IN PARTICULAR FOR A CIRCUIT BREAKER

(75) Inventors: Bernhard Rösch, Sulzbach-Rosenberg (DE); Alexander Spies, Erlangen (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 14/347,714

(22) PCT Filed: Mar. 21, 2012

(86) PCT No.: PCT/EP2012/054970

§ 371 (c)(1),
(2), (4) Date: Mar. 27, 2014

(87) PCT Pub. No.: WO2013/139385

PCT Pub. Date: Sep. 26, 2013

(65) Prior Publication Data

US 2014/0224629 A1 Aug. 14, 2014

(51) Int. Cl.

| | |
|---|---|
| ***H01H 15/02*** | (2006.01) |
| ***H01H 1/20*** | (2006.01) |
| ***H01H 1/32*** | (2006.01) |
| *H01H 50/54* | (2006.01) |

(52) U.S. Cl.
CPC ..... *H01H 15/02* (2013.01); *H01H 1/20* (2013.01); *H01H 1/32* (2013.01); *H01H 50/546* (2013.01)

(58) Field of Classification Search
CPC ..... H01H 15/02; H01H 15/04
USPC ..... 200/50.02, 502, 329; 335/198
See application file for complete search history.

(56) References Cited

U.S. PATENT DOCUMENTS

| | | | | |
|---|---|---|---|---|
| 2,783,340 | A | 2/1957 | Davies et al. | |
| 2,985,736 | A | 5/1961 | Coker | |
| 6,198,058 | B1 * | 3/2001 | Graninger et al. | 200/50.02 |
| 2011/0120844 | A1 | 5/2011 | Hoffmann et al. | |

FOREIGN PATENT DOCUMENTS

| | | | |
|---|---|---|---|
| CN | 200953287 | Y | 9/2007 |
| CN | 101322208 | A | 12/2008 |
| CN | 102074387 | A | 5/2011 |
| DE | 1154553 | B | 9/1963 |
| DE | 19549179 | A1 | 7/1997 |
| DE | 102007015793 | A1 | 10/2008 |
| FR | 1160431 | A | 7/1958 |

(Continued)

OTHER PUBLICATIONS

International Search Report PCT/ISA/210 for International Application No. PCT/EP2012/054970 Dated on Mar. 21, 2012.

(Continued)

*Primary Examiner* — Edwin A. Leon
*Assistant Examiner* — Iman Malakooti
(74) *Attorney, Agent, or Firm* — Harness, Dickey & Pierce, P.L.C.

(57) ABSTRACT

A contact slider unit is disclosed for a switching unit, in particular for a circuit breaker, having a contact slider and a contact piece. In an embodiment, the stabilising element preventing bridge rotation is arranged on the contact piece.

13 Claims, 4 Drawing Sheets

(56) References Cited

FOREIGN PATENT DOCUMENTS

| | | | |
|---|---|---|---|
| FR | 2435793 | A1 | 4/1980 |
| FR | 2895143 | A1 | 6/2007 |

OTHER PUBLICATIONS

International Written Opinion PCT/ISA/237 for International Application No. PCT/EP2012/054970 Dated on Mar. 21, 2012.

Office Action for Chinese Patent Application No. 201280059688X issued on Jul. 15, 2015 with English language translation which corresponds to Co-Pending U.S. Appl. No. 14/347,710.

Office Action for Chinese Patent Application No. 201280059688X issued on Jul. 31, 2015 with English language translation.

Office Action for Co-Pending U.S. Appl. No. 14/347,710 issued on Aug. 24, 2015.

* cited by examiner

CONTACT SLIDER UNIT FOR A SWITCHING UNIT, IN PARTICULAR FOR A CIRCUIT BREAKER

PRIORITY STATEMENT

This application is the national phase under 35 U.S.C. §371 of PCT International Application No. PCT/EP2012/054970 which has an International filing date of Mar. 21, 2012, which designated the United States of America, the entire contents of each of which are hereby incorporated herein by reference.

FIELD

At least one embodiment of the invention generally relates to a contact slide unit for a switching unit, in particular for a circuit breaker, having a contact slide and a switching piece. In addition, the invention relates to a switching unit, in particular a circuit breaker, having a contact slide unit comprising a contact slide and a switching piece.

Switching units, in particular circuit breakers, are used, inter alia, for safe disconnection in the event of a short circuit and thus protect consumers and installations. In addition, electrical or mechanical switching units are suitable for the operationally dependent, manual switching of consumers and for the safe isolation of an installation from the electrical grid in the event of maintenance work or changes to the installation. Electrical switching units, in particular circuit breakers, are often operated electromagnetically.

That is to say that such switching units or circuit breakers are electrical switching devices which are high quality in technical terms with integrated protection for motors, lines, transformers and generators. They are used at service facilities with a low switching frequency. Such switching units, in particular circuit breakers, are also suitable for overload protection, in addition to short-circuit protection.

In the event of a short circuit, an electrical switching unit or a circuit breaker disconnects an electrical installation safely. Thus, this electrical switching unit provides safety protection from overload. Any conductor through which current is flowing is heated to a greater or lesser extent. The heating is in this case dependent on the ratio of the current intensity to the conductor cross section, the so-called current density. The current density should not become too great since, otherwise, the conductor insulation can be scorched by excessive heating and possibly a fire can be triggered. In order to protect electrical installations from these damaging effects, switching units or circuit breakers are used as overcurrent protection device.

Circuit breakers have two tripping mechanisms which act independently of one another for the overload and short-circuit protection. Both releases are connected in series. An electromagnetic release which acts virtually without any delay in time performs the function of protection in the event of a short circuit. In the event of a short circuit, the electromagnetic release unlatches a switching mechanism of the circuit breaker without any delay. A switching armature isolates the switching piece before the short-circuit current can reach its maximum value.

Known switching units or circuit breakers have a contact slide unit comprising a contact slide and a movable switching piece. The movable switching piece also has electrical contacts. In addition, such switching units or circuit breakers have fixed contacts to an electrical line. In a switched-on state, the electrical contacts of the movable switching piece make contact with the fixed contacts of the switching unit or the circuit breaker. In the event of a short circuit, the electrical contacts of the movable switching piece are removed from the fixed contacts, with the result that the current flow is interrupted. In this process, the movable switching piece is detached from the fixed contacts.

Owing to short-circuit disconnections in a switching unit or a circuit breaker, however, after detachment of the movable switching piece, the movable switching piece can be caused to rotate about its longitudinal axis. If the movable switching piece rotates about its longitudinal axis, this is also referred to as "bridge rotator". That is to say that the movable switching piece then, after rotation, no longer returns to its initial position, but remains in the rotated position.

Known contact slides of switching units or circuit breakers often have two guide systems, namely an internal guide system and an external guide system. The external guide system is used when the switching operation, i.e. the switch-on or switch-off operation, takes place via a switching mechanism of the switching unit or the circuit breaker. In this case, no bridge rotator occurs. The internal guide system is used in the event of a short circuit when the switching operation is performed via a switching armature, often a plunger, of the switching unit or the circuit breaker. That is to say that, in the event of disconnection owing to a short circuit, the movable switching piece along the internal guide system leads the contact slide, rebounds at the stop faces in the so-called lower part of the switching unit or the circuit breaker and flies back along the internal guide system again.

In this case, it flies in the opposite direction to the switching armature or the plunger of the switching unit or the circuit breaker. In this case, it may occur that the movable switching piece and the plunger meet one another outside their center lines, with the result that this can lead to a rotation of the movable switching piece about its longitudinal axis.

If the movable switching piece remains in the rotated state, when the switching unit or the circuit breaker is next switched on the contacts, in particular silver contacts of the movable switching piece and the fixed contacts of the switching unit or the circuit breaker, no longer meet one another, with the result that failure phenomena occur. That is to say that a switching piece which remains in a rotated position is disadvantageous since the circuit breaker is then no longer usable. A non-functioning switching piece and a non-functioning switching unit are disadvantageous for the electrical consumers and the installation in which the switching unit or the circuit breaker is installed.

SUMMARY

At least one embodiment of the present invention is directed to providing a contact slide unit for a switching unit, in particular for a circuit breaker, which is designed in such a way that bridge rotators of the switching piece are avoided.

In at least one embodiment of the invention, a contact slide unit for a switching unit is disclosed, in particular for a circuit breaker. Further example embodiments of the invention result from the dependent claims, the description and the drawings. Features and details which are described in connection with the contact slide unit in this case also apply in connection with the switching unit, in particular the circuit breaker, and vice versa.

Switching units in accordance with at least one embodiment of the invention can be electrical switching units, in particular electromagnetically operated switching units or switches, but can also be mechanical switching units. The electrical switching units include in particular circuit breakers.

In accordance with at least one embodiment of the invention, a contact slide is disclosed for a switching unit, in particular for a circuit breaker, which has a contact slide and a switching piece. In at least one embodiment of the invention, a stabilizing element inhibiting bridge rotation is arranged on the switching piece.

BRIEF DESCRIPTION OF THE DRAWINGS

Further advantages and embodiments of the invention will be explained below with reference to example embodiments and with reference to the drawing, in which, in each case schematically.

DETAILED DESCRIPTION OF THE EXAMPLE EMBODIMENTS

Figure 1:
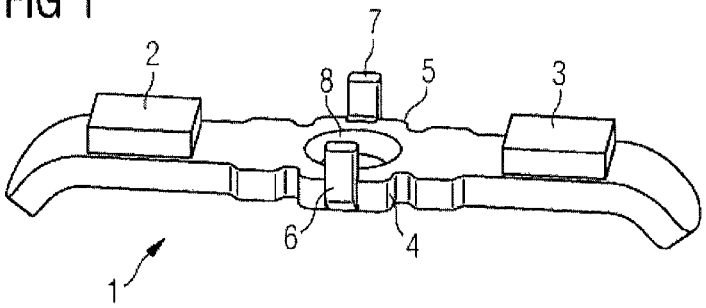
FIG. 1 shows a perspective illustration of a first example embodiment of a switching piece according to the invention comprising stabilizing elements as antirotation devices during the switching operation.

Switching units in accordance with at least one embodiment of the invention can be electrical switching units, in particular electromagnetically operated switching units or switches, but can also be mechanical switching units. The electrical switching units include in particular circuit breakers.

In accordance with at least one embodiment of the invention, a contact slide is disclosed for a switching unit, in particular for a circuit breaker, which has a contact slide and a switching piece. In at least one embodiment of the invention, a stabilizing element inhibiting bridge rotation is arranged on the switching piece.

In accordance with at least one embodiment of the invention, preferably two mutually opposite horns are embossed on the contact bridge. In addition, guide grooves are let into the movable contact slide and hold these horns and therefore the bridge in the vertical and horizontal position within permissible rotation limits. The guide grooves are matched to the bridge horns in such a way that the tolerances are suitable for manufacturing and prevent a rotation of the bridge. This rotation is then prevented effectively both about the y axis and about the x axis.

In addition, at least one embodiment of the invention provides that when embossing hits the bridge in the center of the bridge, the plunger is caught or centered. This prevents the bridge from sliding away laterally, which would be associated with a rotation of the bridge about the x axis. As a result, the plunger therefore hits the bridge centrally.

In terms of manufacture, providing horns or guides on the bridge does not present a problem. For this, the guide grooves can be introduced into the contact slide. The perpendicular tabs for the bridge guide which keeps a rotation about the x axis and about the y axis within limits are essential to the invention. In addition, this rotation can also be prevented by inbuilt embossing on the bridge for centering the plunger. The diameter of the embossing is matched to the plunger diameter.

An advantage of at least one embodiment of the invention resides in that a complete rotation of the contact bridge in all directions is prevented. This also prevents the switch from becoming unfunctional as a result of a rotated or upended bridge. In addition, the central embossing prevents the plunger from hitting the bridge center eccentrically. As a result, the risk of the bridge sliding off on the plunger or subsequent rotation is minimized.

The sliding piece according to at least one embodiment of the invention is preferably in the form of a web and has a contact at each end. These two contacts enter into a conductive connection with two fixed contacts (not illustrated) in the switched-on state of the switching unit, in which the switching piece is integrated. Two preferably mutually opposite projections are arranged in the central region of the preferably web-shaped switching element and engage in guide grooves in the contact slide. Preferably two mutually opposite bridge horns which are preferably arranged at a 90° angle with respect to the switching piece are positioned on these projections and, during a rotational movement, form touch points with the inner wall of the contact slide, with the result that a further rotation is suppressed by the inner wall. In addition, embossing can be arranged centered in the central region of the switching piece and guides or centers the plunger arranged in the contact slide.

The contact slide unit according to at least one embodiment of the invention prevents, by way of the embossed stabilizing elements in the form of bridge horns or half-shells, a complete rotation of the contact bridge in all directions. In particular, a rotated or upended bridge is thus prevented, which would result in the switch becoming unfunctional. Advantageously, in addition the plunger is prevented from hitting the bridge center eccentrically by virtue of the fact that central embossing is positioned in the bridge center. As a result of this, too, the risk of the bridge sliding off on the plunger and thus a subsequent rotation is minimized.

FIG. 1 shows a first example embodiment of a switching piece 1 according to the invention, which is preferably in the form of a web and has a contact 2, 3 at each end. These two contacts 2, 3 enter into a conductive connection with two fixed contacts (not illustrated) in the switched-on state of the switching unit in which the switching piece is integrated. Two preferably mutually opposite projections 5, 6 are arranged in the central region 4 of the preferably web-shaped switching piece 1 and engage in guide grooves in the contact slide.

Two mutually opposite stabilizing elements 6, 7 which are preferably arranged at a 90° angle to the switching piece 1 and are in the form of bridge horns are preferably positioned on these projections 5, 6 and, during a rotational operation, form touch points with the inner wall of the contact slide, with the result that a further rotation is suppressed by the inner wall. In addition, embossing 8 can be arranged centered in the central region 4 of the switching piece 1 and guides or centers the plunger arranged in the contact slide.

Figure 2:
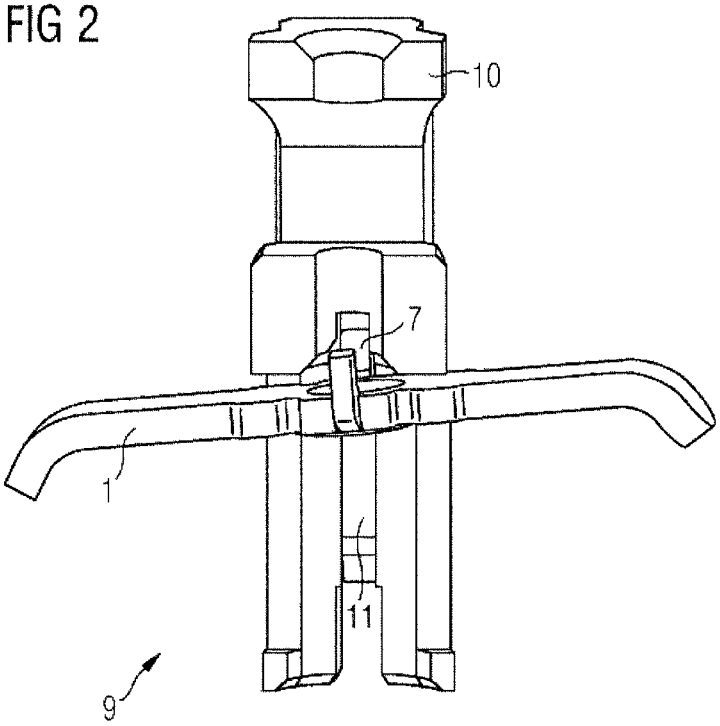
FIG. 2 shows a perspective sectional illustration of a contact slide unit according to an embodiment of the invention comprising a contact slide and a switching piece.

FIG. 2 shows a contact slide unit 9 according to an embodiment of the invention which comprises a switching piece 1 and a contact slide 10. The contact slide 10 has a guide groove 11 which runs downwards in the movement direction of the switching piece 1 during a tripping operation and in which the stabilizing element 7 engages. The movement direction of the switching piece in the x direction is limited by the guide groove 11 in the event of a switching operation.

Figure 3:
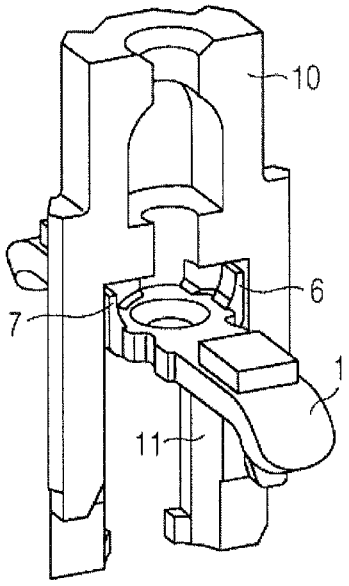
FIG. 3 shows a perspective illustration of a switching piece according to an embodiment of the invention comprising two embossed stabilizing elements which are arranged in guide grooves in the contact slide.

FIG. 3 shows the switching piece 1 according to an embodiment of the invention comprising two embossed stabilizing elements 6, 7 which are guided in guide grooves 11 in the contact slide 10.

Figure 4:
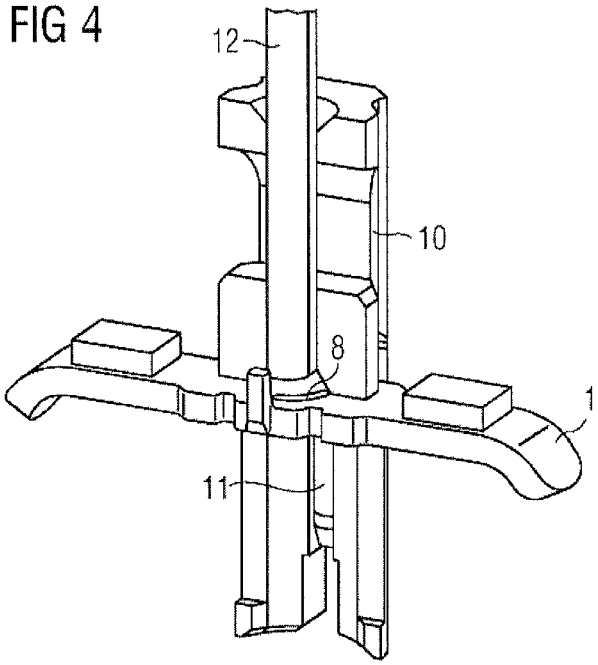
FIG. 4 shows a perspective illustration of a switching piece according to an embodiment of the invention with embossing for the plunger guidance.

FIG. 4 shows the switching piece 1 with contact slide 10, wherein the switching piece 1 additionally has the embossing 8, which centers a plunger 12 during the switching operation.

Figure 5:
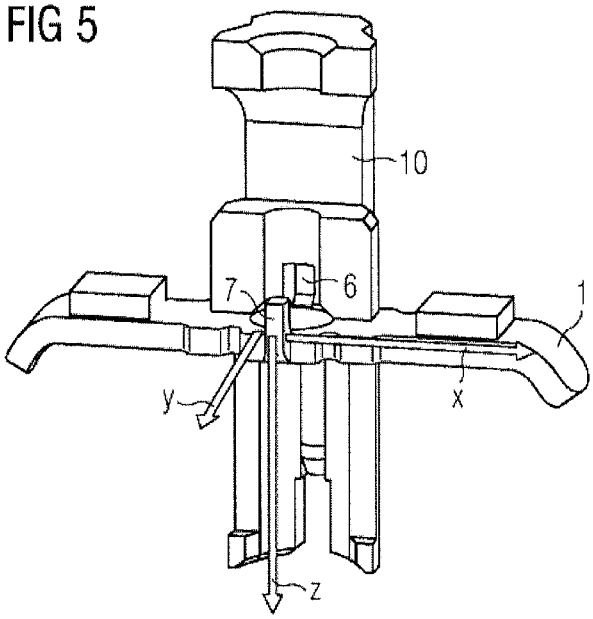
FIG. 5 shows a perspective illustration of a contact slide unit according to an embodiment of the invention comprising a contact slide and a switching piece and the three possible movement directions of the switching piece.

FIG. 5 shows the contact slide unit 9 according to an embodiment of the invention comprising contact slide 10 and switching piece 1 and the three possible movement directions in the x, y and z directions of the switching piece 1.

Figure 6:
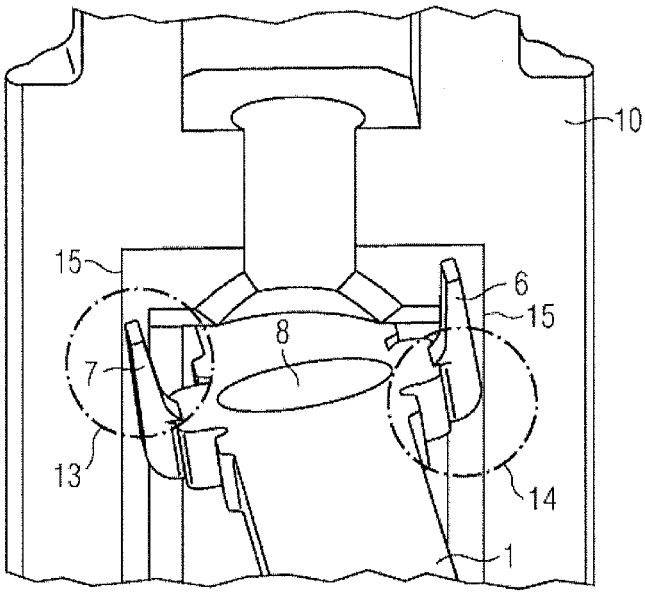
FIG. 6 shows a perspective sectional illustration of the touch points of the stabilizing element of the switching piece with the inner wall of the contact slide.

FIG. 6 shows the movement of the switching piece 1 in the event of a switching operation in the y direction. The rotation of the switching piece 1 during the switching operation results in the stabilizing elements 6 and 7 forming touch points 13 and 14 with the inner wall 15 of the contact slide 10.

Figure 7:
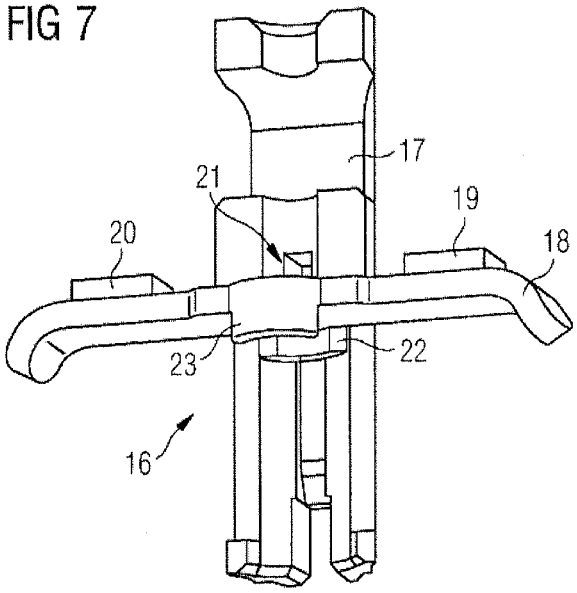
FIG. 7 shows a perspective sectional illustration of a second example embodiment of a contact slide unit according to an embodiment of the invention comprising a contact slide and a switching piece.
Figure 8:
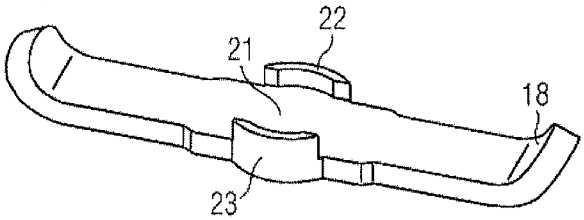
FIG. 8 shows a perspective illustration of the switching piece shown in FIG. 7.

FIG. 7 shows a second example embodiment of a contact slide unit 16 according to the invention comprising contact slide 17 and switching piece 18. The switching piece 18 is preferably web-shaped in the same way as the switching piece 1 and has a contact 19, 20 at each end. These contacts 19, 20 enter into a conductive connection with two fixed contacts (not illustrated) in the switched-on state of the switching unit in which the switching piece 18 is integrated. Preferably two embossed half-shells 22, 23 are arranged in the central region 21 of the preferably web-shaped switching piece 18 and are used as antirotation device in the event of a tripping operation. FIG. 8 shows the switching piece 18 as shown in FIG. 7.

Figure 9:
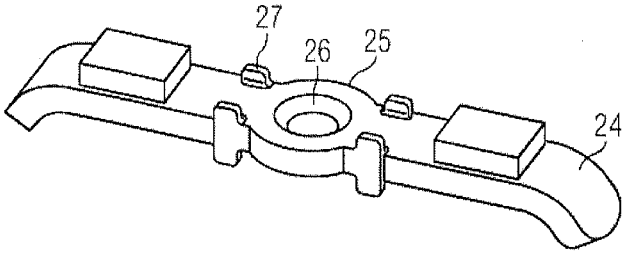
FIG. 9 shows a perspective illustration of a third example embodiment of a switching piece according to the invention comprising four embossed horns.

FIG. 9 shows a third example embodiment of a switching piece 24 according to the invention which has embossing 26 for the plunger to be guided in the central region 25. Preferably four stabilizing elements 27 in the form of protruding bridge horns are arranged around the embossing 26.

The contact slide unit according to an embodiment of the invention prevents a complete rotation of the contact bridge in all directions by way of the embossed stabilizing elements in the form of bridge horns or half-shells. In particular, a rotated or up-ended bridge is thus prevented, which would result in the switch becoming unfunctional. Advantageously, in addition the plunger is prevented from hitting the bridge center eccentrically by virtue of the fact that central embossing is positioned in the bridge center. As a result of this, too, the risk of the bridge sliding off on the plunger and thus of subsequent rotation is minimized.

The invention claimed is:

1. A contact slide unit for a switching unit, comprising:

a contact slide;

a switching piece having a central region that includes projections extending therefrom and a stabilizing element positioned on the projections, the stabilizing element configured to inhibit bridge rotation; and a plunger, arranged in the contact slide, and guidable by embossing in a center of the central region of the switching piece, the embossing having a diameter matched to a diameter of the plunger such that the plunger is received within the embossing.

2. The contact slide unit of claim 1, wherein the stabilizing element configured to inhibit bridge rotation on the switching piece is in the form of an embossed bridge horn.

3. The contact slide unit of claim 1, wherein guide grooves are let into the contact slide and the projections engage in the guide grooves in the contact slide to guide the stabilizing element, and thereby the switching piece, in a vertical and horizontal position.

4. The contact slide unit of claim 1, wherein two mutually opposite stabilizing elements are arranged on the switching piece, each configured to engage in a corresponding guide groove in the contact slide.

5. A switching unit, comprising:

the contact slide unit of claim 1.

6. The contact slide unit of claim 1, wherein the contact slide unit is for a circuit breaker.

7. The contact slide unit of claim 2, wherein guide grooves are let into the contact slide to guide the stabilizing element, and thereby the switching piece, in a vertical and horizontal position.

8. A switching unit, comprising:

the contact slide unit of claim 2.

9. A circuit breaker, comprising:

the contact slide unit of claim 1.

10. A circuit breaker, comprising:

the contact slide unit of claim 2.

11. The contact slide unit of claim 2, wherein two mutually opposite stabilizing elements are arranged on the switching piece, each configured to engage in a corresponding guide groove in the contact slide.

12. The contact slide unit of claim 2, further comprising:

a plunger, arranged in the contact slide, and guidable by embossing in the switching piece.

13. The contact slide unit of claim 1, further comprising a plunger arranged in the contact slide that directly contacts the embossing of the switching piece.

* * * * *